US007018066B2

(12) United States Patent
Kirven

(10) Patent No.: US 7,018,066 B2
(45) Date of Patent: Mar. 28, 2006

(54) DECORATIVE COIL LIGHTS

(76) Inventor: Betty Kirven, 704-12th Ave., South, North Myrtle Beach, SC (US) 29582

( * ) Notice: Subject to any disclaimer, the term of this patent is extended or adjusted under 35 U.S.C. 154(b) by 30 days.

(21) Appl. No.: 09/924,835

(22) Filed: Aug. 8, 2001

(65) Prior Publication Data

US 2005/0225981 A1 Oct. 13, 2005

(51) Int. Cl.
*F21V 21/00* (2006.01)

(52) U.S. Cl. ..... 362/249; 362/252; 362/391; 362/806

(58) Field of Classification Search ..... 362/249, 362/252, 806, 123, 227, 391
See application file for complete search history.

(56) References Cited

U.S. PATENT DOCUMENTS 2,468,773 A 5/1949 Musinski
4,542,446 A * 9/1985 Shiff et al. ..... 362/122
4,620,270 A 10/1986 Laakso
4,885,664 A 12/1989 Hermanson
5,405,662 A 4/1995 Oberzan
5,413,825 A 5/1995 Chaikin
5,934,793 A * 8/1999 Rahman ..... 362/249
6,048,590 A 4/2000 Phillips
6,132,063 A 10/2000 Byers

FOREIGN PATENT DOCUMENTS

DE 44 24 656 A1 7/1994

OTHER PUBLICATIONS

Paramount Wire Co.—website on Memory Wire.

* cited by examiner

*Primary Examiner*—Thomas M. Sember
(74) *Attorney, Agent, or Firm*—Sughrue Mion, PLLC

(57) ABSTRACT

Decorative coil string lights that are easily applied to and removed from a Christmas tree, for example, and are easily stored without tangling of the wires. The coil lights are formed of a string of decorative lights that are attached to a coil of memory wire. The coiled memory wire expands and automatically retracts back its original length when released. Thus, the coil string lights expand for easy placement of the lights and then retract for easy storage. The coil string lights provide increased light density to create a more visually pleasing effect because the electrical wires do not sag between the bulbs and the bulbs are supported by the spiral structure of the coiled memory wire.

7 Claims, 1 Drawing Sheet

DECORATIVE COIL LIGHTS

BACKGROUND OF THE INVENTION

The present invention relates to decorative string lights, and more particularly, to decorative string lights integrated with coiled memory wire to provide a light assembly that is visually pleasing, and easy to apply and store.

Decorative string lights, such as Christmas lights, are generally formed of insulated electrical wire and a plurality of small bulbs. The lengths of the string lights vary, along with the sizes, colors, and number of bulbs on the string.

When a set of string lights is applied to a Christmas tree, the string is generally wrapped around the trunk of the tree and along the branches of the tree. It is difficult to maintain a high density degree of the lights on the branches while hiding the excess insulated wire between the bulbs because the wire between the bulbs tends to sag from the branches, which is not visually pleasing. Further, standard string lights generally become tangled when they are removed from a Christmas tree and stored, unless significant time is invested in placing the string lights onto an oscillating light rack.

Accordingly, there is a need in the art for decorative string lights that provide increased visual pleasure and ease in applying and storing the lights.

SUMMARY OF THE INVENTION

The present invention provides a lighting apparatus formed of: decorative lights that include electrical wire and a plurality of light bulbs electrically connected to the electrical wire; and a wire coil such that the decorative lights are attached to the wire coil. In a preferred embodiment, the wire coil is formed of a memory wire coil that is expandable and automatically retractable to its original length when released, and the decorative lights are integrally bound to the wire coil. In an additional embodiment, the electrical wire includes at least two intertwined electrical wires, and the wire coil extends between the intertwined electrical wires. The lighting apparatus of the present invention preferably expands and resiliently retracts to its original length when released.

A method for making a decorative lights apparatus is also provided. The method includes the step of attaching decorative lights to a wire coil, the decorative lights including electrical wire and a plurality of light bulbs, and the wire coil being expandable and resiliently retractable to its original length when released. In one embodiment, the attaching step includes integrally binding the electrical wire to the wire coil. In an additional embodiment, the attaching step includes extending the wire coil through at least two intertwined wires of the electrical wire.

BRIEF DESCRIPTION OF THE DRAWINGS

The present invention is better understood by a reading of the Detailed Description of the Preferred Embodiments along with a review of the drawings, in which.

DETAILED DESCRIPTION OF THE PREFERRED EMBODIMENTS

The illustrations and examples discussed in the following description are provided for the purpose of describing the preferred embodiments of the invention and are not intended to limit the invention thereto.

Figure 1:
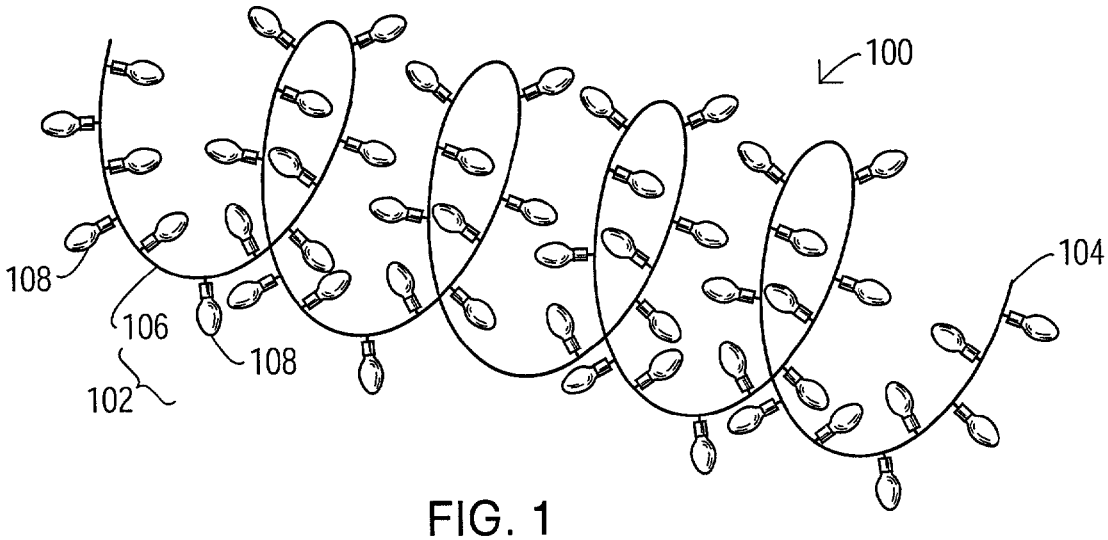
FIG. 1 is a perspective view of the coil lights of the present invention in expanded form.
Figure 2:
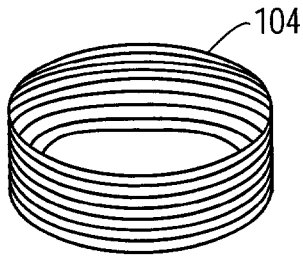
FIG. 2 is a perspective view of coiled memory wire in accordance with the present invention.

As shown in FIG. 1, the coil lights 100 of the present invention are formed of a string of decorative lights 102 and coiled memory wire 104. The string lights 102 include insulated electrical wire 106 and a plurality of bulbs 108, and are attached to the memory wire coil 104 to form the present invention. Memory wire is wire made of nickel and titanium, called nitinol. The wire is easily bent and "remembers" its shape when it is molded while being heated. Memory wire is commonly molded into the shape of a coil or spring, such as the coil 104 shown in FIG. 2. The coiled memory wire 104 has a high spring retention and resiliently retracts to its original length after being expanded. Coiled memory wire 104 is manufactured in a plurality of wire diameters and coil diameters.

Figure 3:
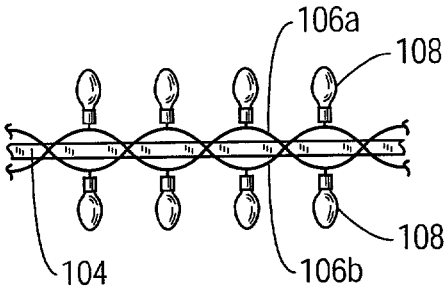
FIG. 3 is a schematic view of coiled memory wire fed through intertwined insulated wires of a set of string lights.
Figure 4:
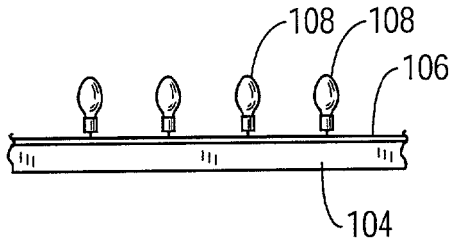
FIG. 4 is a schematic view of insulated wire integrally bound to insulated electrical wire of a set of string lights.

In a preferred embodiment of the present invention, a standard set of string lights 102 is attached to coiled memory wire 104 such that the memory wire 104 is substantially covered by the string lights 102. The string lights 102 may be attached to the memory wire 102 by a plurality of methods. In a first method, a set of string lights 102 includes at least two strands of insulated electrical wire 106*a*, 106*b* that are intertwined or plaited with one another, as shown in FIG. 3. The memory wire 104 is fed through the intertwined or plaited electrical wires 106*a*, 106*b* such that the string lights 102 fit snugly with the memory wire 104.

In a second embodiment, the string lights 102 are integrally manufactured with the memory wire 104. Specifically, as shown in FIG. 6, the memory wire 104 may be encapsulated in insulation, similar to the insulated electrical wire 106. The encapsulated memory wire 104 may be bound together with the insulated electrical wire 106.

The decorative coil lights 100 of the present invention provide several advantages over prior art decorative string lights and have a plurality of uses. For example, an average strand of 100-bulb string lights measures about 46 feet. When the same strand of string lights is attached to a 1-⅜" diameter memory wire coil 104 by one of the above-described methods, for example, the resulting coil of string lights is about 30" long. The coil expands, thereby allowing for easy placement of the coil around a Christmas tree base and branches. The amount of time associated with decorating a Christmas tree with prior art decorative string lights is dramatically reduced by using the coil lights 100 of the present invention. The circular design of the memory wire supports the lights and prevents sagging associated with prior art string lights. The circular design also helps to prevent sagging of the connecting plugs when coil lights sets are connected to one another. Thus, the lights appear to "stand away" from the cords for increased light density, thereby providing a more visually pleasing display and making it easier to identify blown bulbs. Further, the coil lights 100 provide a unique spiral pattern that is also visually pleasing.

Unlike prior art decorative light strings, the coil lights 100 of the present invention are easily disassembled. Specifically, the coil lights 100 automatically return to their compressed length and are then available for storage. As mentioned above, there is no concern over the cords tangling during storage or with tediously winding the cord around an oscillating storage rack.

Certain modifications and improvements will occur to those skilled in the art upon a reading of the foregoing description. For example, the coil lights of the present invention are not limited to application on Christmas trees or indoor use. Rather, the coil lights may be applied in several ways used in a variety of applications, such as on stair rails, wreaths, garland, lampposts, mail boxes, shrubbery, columns, porch railings. All such modifications and improvements of the present invention have been deleted herein for the sake of conciseness and readability but are properly within the scope of the following claims.

What is claimed is:

1. A lighting apparatus comprising:

decorative lights comprising:

electrical wire, and a plurality of light bulbs electrically connected to the electrical wire; and a wire coil having substantially the same radius throughout the wire coil;

wherein the decorative lights are attached to the wire coil, and wherein the electrical wire includes at least two intertwined electrical wires, and the wire coil extends between the intertwined electrical wires.

2. A lighting apparatus as claimed in claim 1 wherein the wire coil is a memory wire coil that is expandable and automatically retractable to its original length when released.

3. A lighting apparatus as claimed in claim 2 wherein the wire coil is not substantially flat when the wire coil is in its retracted state.

4. A lighting apparatus as claimed in claim 1 wherein the decorative lights are integrally bound to the wire coil.

5. A lighting apparatus as claimed in claim 1 wherein the lighting apparatus is expandable and resiliently retractable to its original length when released.

6. A method for making a decorative lights apparatus comprising the step of attaching decorative lights to a wire coil, said decorative lights comprising:

electrical wire, and a plurality of light bulbs;

said wire coil having substantially the same radius throughout the wire coil; and said wire coil being expandable and resiliently retractable to its original length when released, wherein said attaching step includes extending the wire coil through at least two intertwined wires of the electrical wire.

7. A method as claimed in claim 6 wherein said attaching step includes integrally binding the electrical wire to the wire coil.

* * * * *